US008025178B2

(12) United States Patent
Miller

(10) Patent No.: US 8,025,178 B2
(45) **Date of Patent: *Sep. 27, 2011**

(54) DRINKING VESSEL

(75) Inventor: Austen Charles Miller, Whitchurch (GB)

(73) Assignee: 0Z10 Limited, Hampshire (GB)

( * ) Notice: Subject to any disclaimer, the term of this patent is extended or adjusted under 35 U.S.C. 154(b) by 0 days.

This patent is subject to a terminal disclaimer.

(21) Appl. No.: 12/467,558

(22) Filed: May 18, 2009

(65) Prior Publication Data

US 2009/0223968 A1 Sep. 10, 2009

Related U.S. Application Data

(63) Continuation of application No. 10/894,095, filed on Jul. 19, 2004, now Pat. No. 7,549,556, which is a continuation of application No. PCT/GB03/00182, filed on Jan. 17, 2003.

(30) Foreign Application Priority Data

Jan. 18, 2002 (GB) ..... 0201185.6
Jan. 16, 2003 (GB) ..... 0300988.3

(51) Int. Cl.
*A47G 19/22* (2006.01)

(52) U.S. Cl. ..... 220/714; 220/717; 220/203.12; 137/853; 215/388

(58) Field of Classification Search ..... 220/203.11, 220/203.12, 203.16, 203.19, 711, 713, 714, 220/717, 718, 719; 215/11.4, 387, 388; 222/485, 222/490; 137/853
See application file for complete search history.

(56) References Cited

U.S. PATENT DOCUMENTS 5,890,619 A * 4/1999 Belanger ..... 220/713
6,758,364 B1 * 7/2004 Rohrig ..... 220/714
2001/0035420 A1 * 11/2001 Fusco et al. ..... 220/714

FOREIGN PATENT DOCUMENTS

WO WO 9947029 A1 * 9/1999

* cited by examiner

*Primary Examiner* — Anthony Stashick
*Assistant Examiner* — James N Smalley
(74) *Attorney, Agent, or Firm* — Eugene M. Cummings, P.C.

(57) ABSTRACT

According to the invention a drinking vessel (10) comprises a generally cylindrical container (11) adapted to contain liquid and a generally cylindrical lid (12) adapted to close the container. The lid comprises a generally cylindrical outer member (20), a generally cylindrical inner member (22) located within the outer member so as to define a generally cylindrical aperture (50) between the outer surface of the inner member and the inner surface of the outer member, and a generally cylindrical sealing element (21) located in the aperture. The sealing element normally forms a seal between the outer surface of the inner member and the inner surface of the outer member but is deformable by suction at the end of the aperture remote from the container so as to cause liquid within the container to flow, from the end of the aperture adjacent to the container, out through the aperture under the action of the suction.

6 Claims, 6 Drawing Sheets

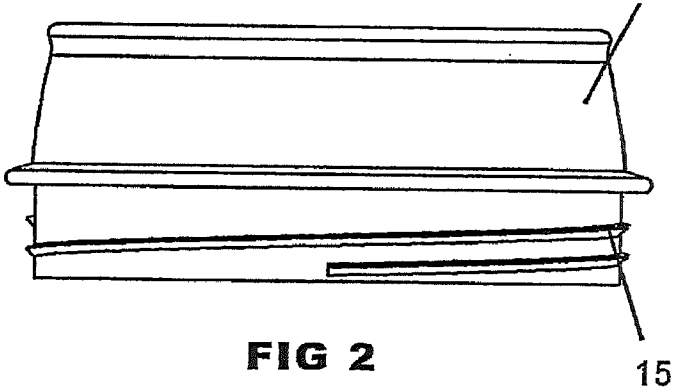
FIG 2
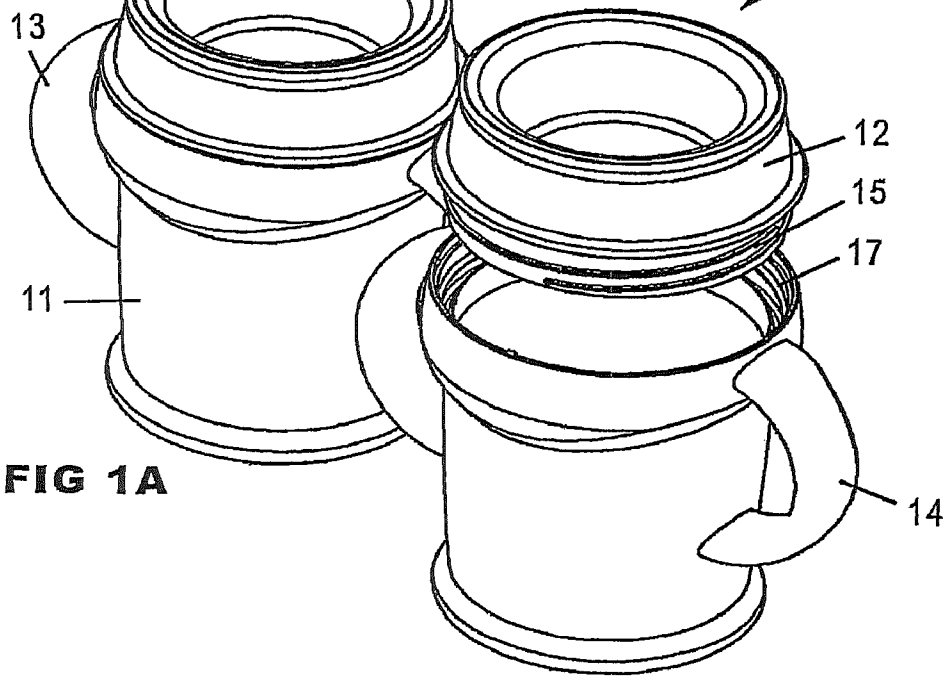
FIG 1B
FIG 1A

DRINKING VESSEL

This application is a continuation of U.S. application Ser. No. 10/894,095 filed Jul. 19, 2004 now U.S. Pat. No. 7,549,556 which is a continuation of copending PCT International Application Number PCT/GB03/000182 having an International Filing Date of 17 Jan. 2003, and which was published in English as International Publication Number WO 03/061438 A1 on 31 Jul. 2003, and which claims the benefit of priority application GB0300988.3 filed 16 Jan. 2003, and priority application GB0201185.6 filed 18 Jan. 2002. The present invention relates to a drinking vessel, in particular to a drinking vessel of the type known as a trainer cup.

BACKGROUND OF THE INVENTION

1. Field of the Invention
2. Related Background Art

Trainer cups comprising a container for liquid with a lid including a mouthpiece, usually in the form of a spout, are well known for use at an intermediate stage in a child's development as it moves from drinking from a feeding bottle or the breast to drinking from a conventional cup or glass.

However, at that stage, the child will not have learned that if cups are knocked over or shaken, the liquid inside will be spilt. Accordingly, there is a need for the development of trainer cups which are adapted not to spill their contents when shaken or upturned.

United Kingdom Patent Specification GB 2 266 045 A describes such a cup in which a one-way valve is provided within the spout of the lid of a trainer cup.

The valve is formed by a slit formed in an externally convex portion of a sheet of flexible material such as latex or silicone rubber. The valve opens in response to suction on the spout by the child, thereby allowing egress of fluid from the cup. The convexity of the valve provides the one-way characteristic of the valve. A second one-way valve is provided to allow ingress of air into the cup, to prevent the build up of a vacuum.

However, at some stage in a child's development, it will need to learn the skills involved in drinking from the rim of an ordinary cup. Typically this is done by wholly removing the lid from the trainer cup. However, in doing so, the spill-resistance advantages are completely lost. The object of the present invention is to provide an improved drinking vessel which can be used as a trainer cup.

SUMMARY OF THE INVENTION

According to the invention a drinking vessel comprises a generally cylindrical container adapted to contain liquid and a generally cylindrical lid adapted to close the container, in which the lid comprises a generally cylindrical outer member, a generally cylindrical inner member located within the outer member so as to define a generally cylindrical aperture between the outer surface of the inner member and the inner surface of the outer member, and a generally cylindrical sealing element located in the aperture.

The sealing element normally forms a seal between the outer surface of the inner member and the inner surface of the outer member but is deformable by suction at the end of the aperture remote from the container so as to cause liquid within the container to flow, from the end of the aperture adjacent to the container, out through the aperture under the action of the suction.

Typically the sealing element is formed from a resiliently deformable natural or synthetic rubber or plastics material. Latex and silicone rubber are particularly suitable materials.

BRIEF DESCRIPTION OF THE DRAWINGS

In order that the invention may be more readily understood reference will now be made to the accompanying drawings, in which:

FIG. 1A is a perspective view of a drinking vessel in accordance with the present invention, in the form of a container with a lid FIG. 1B is a perspective view of the drinking vessel illustrated in FIG. 1A with the lid detached from the container FIG. 2 is a side view of the lid of the drinking vessel illustrated in FIG. 1

DETAILED DESCRIPTION OF THE PREFERRED EMBODIMENT

Figure 3:
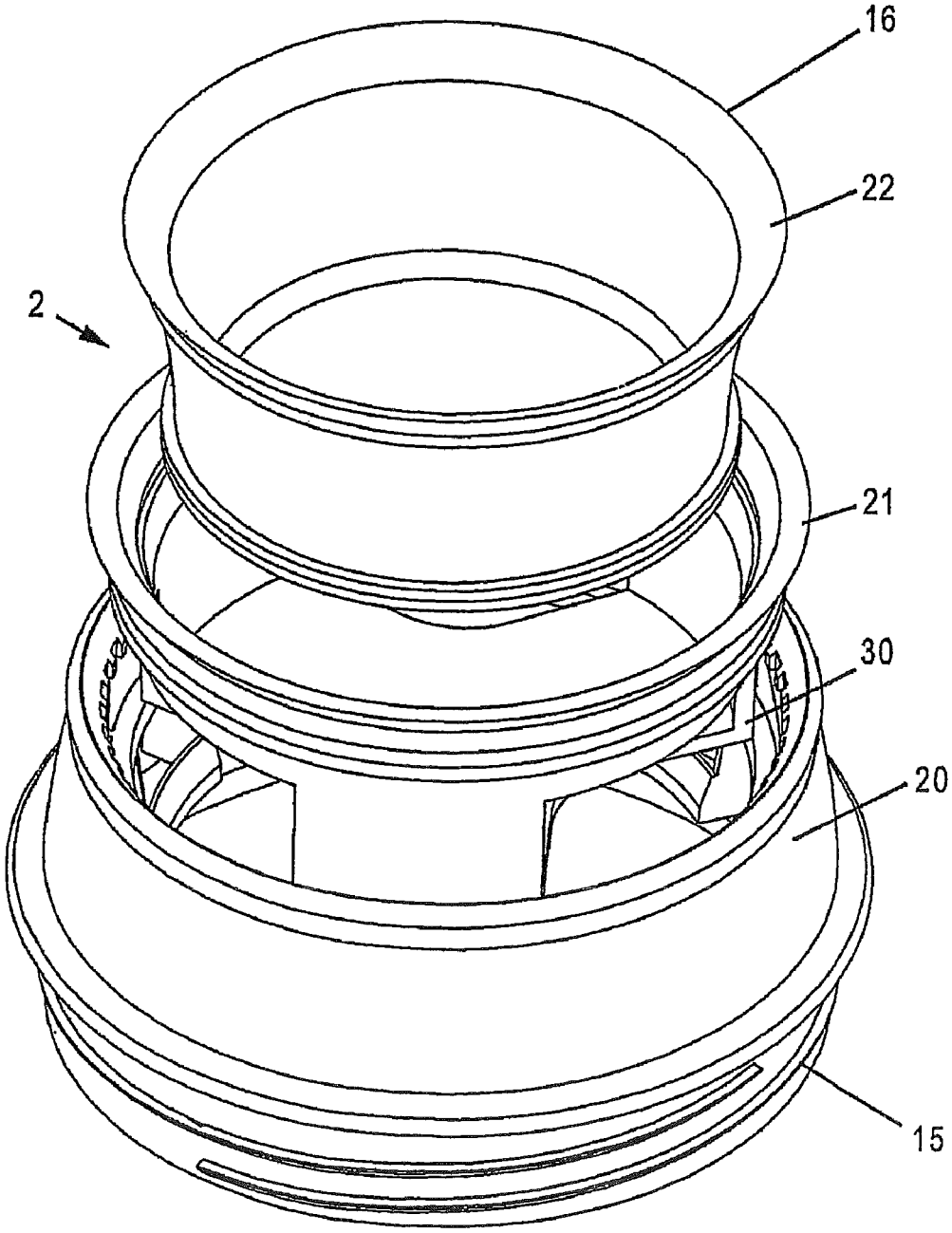
FIG. 3 is an exploded perspective view of the lid

FIGS. 1A and 1B and 2 show a drinking vessel in the form of a trainer cup 10 and having a generally cylindrical container 1 to hold liquid drink and a generally cylindrical lid 12 adapted to be fitted into the mouth or top opening of the container 11. Container 11 is provided with two oppositely disposed handles 13, 14. As is most clearly seen from FIGS. 1B and 2, lid 12 is a screw fit into container 11, by means of a threaded portion 15 which cooperates with a corresponding threaded portion in the mouth or top opening of the container 11 as described below.

Figure 4:
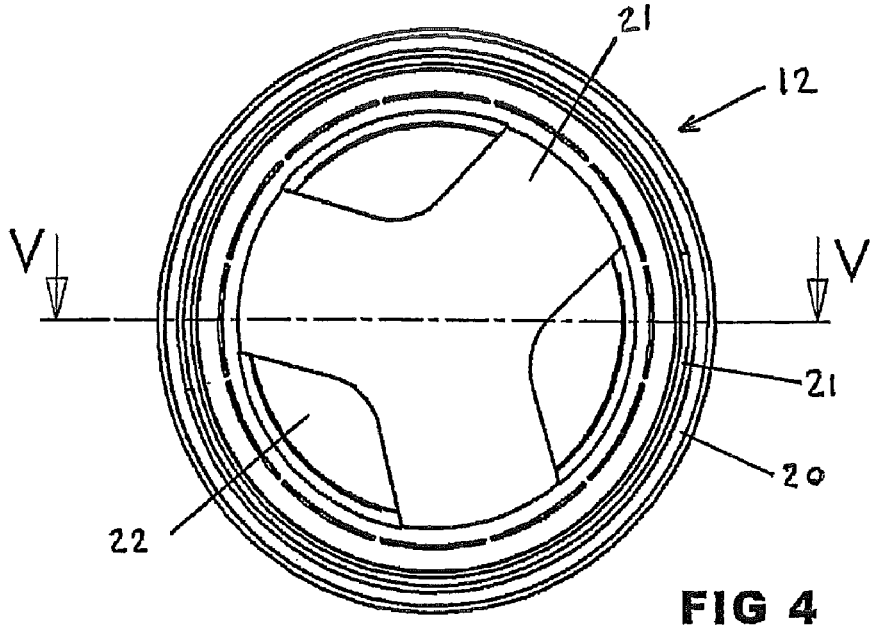
FIG. 4 is a plan view of the lid

Referring to FIG. 3, the lid 12 comprises three components, a generally cylindrical outer member 20, an annular sealing element 21 and a generally cylindrical inner member 22. The outer member 20 includes an outer wall having an externally threaded portion 15 for engagement with a corresponding internally threaded portion 17 on the inner wall of the container 11 and provides, at its edge furthermost from the container 11, a lip 16. As is most clearly seen in FIGS. 4 to 9, inner member 22 is generally dish-shaped including a circular base 23 with a wall 24 upstanding therefrom. In FIG. 4 the lower portion of the sealing element 21 is shown in phantom because it is located below the base 23 of the inner member 22. Base 23 of inner member 22 is enlarged to provide a foot 25 extending around the base 23 and radially outwardly beyond the wall 24. Wall 24 has an outer ridge 26 which extends around the watt 24 and radially outwardly from the wall 24 by an amount greater than that by which foot 25 extends. Upon insertion of the inner member 22 into the outer member 20. foot 25 engages with and is retained by three projections 30 (FIGS. 3 and 5) extending radially inwardly from the side wall of the outer member 20. Only one projection 30 is illustrated since the other two are obscured in Figured by the inner member 22. Ridge 26 of inner member 22 extends outwardly underneath a ledge 31 which extends around the side wall of outer member 20 at a point closer to lip 16 than projections 30 and projects inwardly. Inner member 22 is thus retained generally within the outer member 2G but the dimensions of the components allow the inner member 22 to be inserted into and removed from within the outer member 20.

When the inner member 22 is inserted into the outer member 20, the inner surface 34 of the outer member 20 and the outer surface of inner member 22 together define, in the assembled lid, an annular aperture 50 therebetween.

In the fully assembled lid, seating element 21 is located within the annular aperture 5G. Sealing element 21 is shaped (see FIG. 11) so as to provide inner surfaces 32 providing a firm seal with the outer surface 35 of inner member 22 adjacent to the ridge 26 and outer surfaces 27 providing a firm seat with the inner surface 34 of the outer member 20 adjacent to the ridge 26. All three components 20, 21, 22 are mutually shaped to achieve this result. The thickness of sealing member 21 tapers towards an upper edge 33. The inner surface 34 of outer member 20 has a frusto-conical shape against which the upper edge 33 of the outer surface 27 of sealing element 21 bears. The outer edges of the outer member 30, of the sealing element 21 and of the inner member 20 are so shaped as to provide a substantially smooth combined surface forming the lip 16 which does not feet uncomfortable in the mouth of a person drinking from the vessel.

Figure 11:
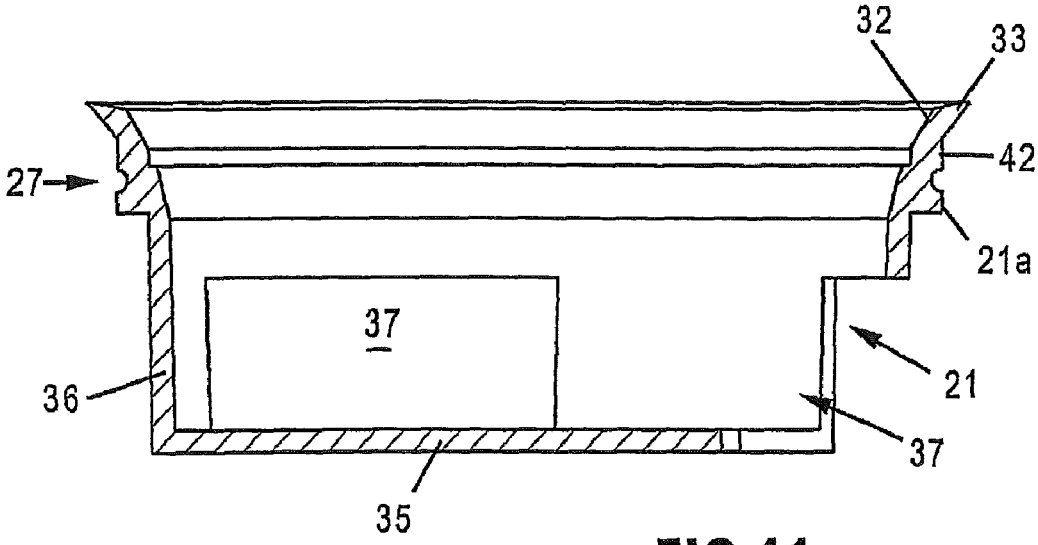
FIG. 11 is a side view of the sealing element of the lid sectioned along the line XI-XI of FIG. 10.
Figure 10:
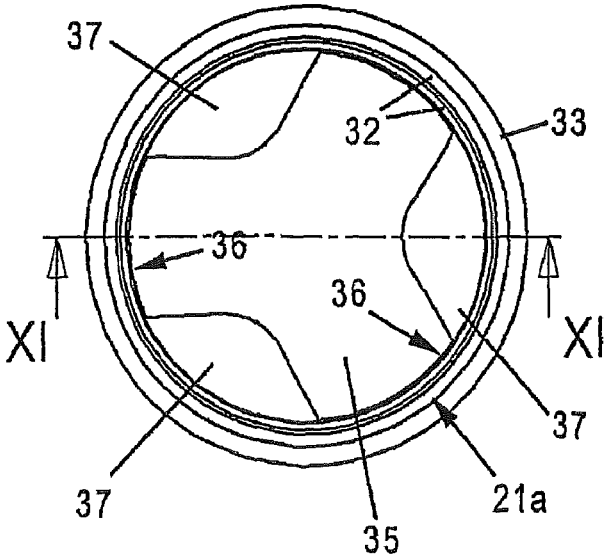
FIG. 10 is a plan view of the lid showing the sealing element

The sealing element 21 is illustrated in FIGS. 10 and 11. The annular part 21*a* of the sealing element 21 is attached to an apertured base 35 by three side wall elements 36. The base 35 serves to assist in retaining the correct shape of the annular part 21*a* of the sealing element 21, which might otherwise, with a lack of careful handling, become distorted during assembly of the lid. Three apertures 37 in the base 35 are provided to assist in mounting the sealing element 21 over the inner member 22 by allowing release of any air which might otherwise become trapped between the two components and also avowing the three radially inwardly extending projections 30 (see FIG. 5) to make contact with the foot 25 of base 23 of the inner member 20. Further, the base 23 of the inner member 22, in making contact with the upper surface of the base 35 of the sealing element 21, exerts a force on the sealing element 21 tending to make it engage firmly in the aperture 50 with the outer surface of the inner member 22 and the inner surface of the outer member 20.

Figure 12:
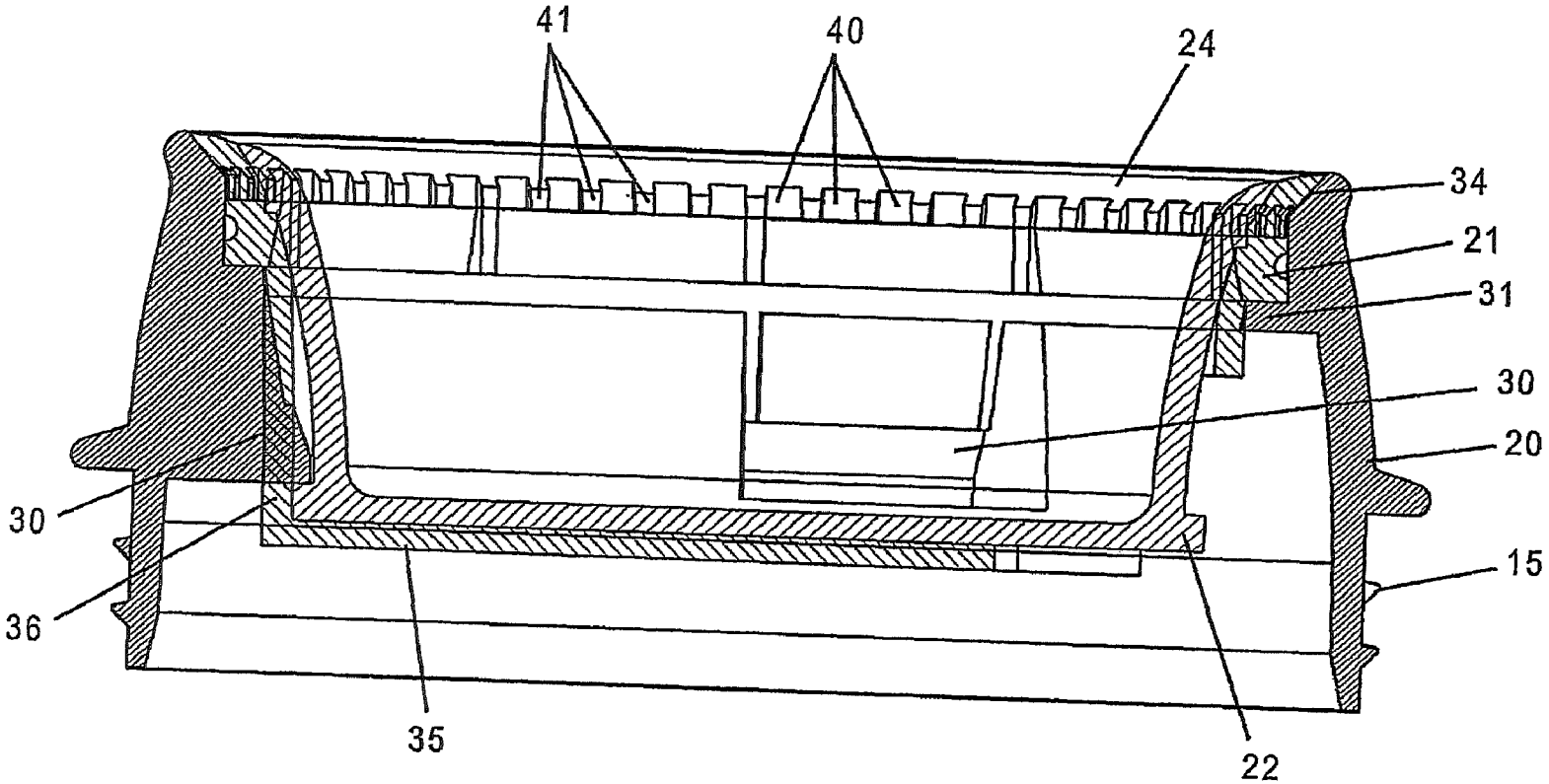
FIG. 12 is a side view of the lid sectioned along the fine XI-XI of FIG. 10.

As frustrated in FIG. 12 outer member 20 includes a row of teeth or projections 40 extending radially inwardly immediately below frusto-conical surface 34. Gaps 41 are formed between projections 40. Projections 40 act against a radially outwardly projecting ridge 42 formed in the outer surface of the annular sealing element 21 to retain the sealing element in position in the assembled lid. They also act, secondarily, to maintain generally the correct circular form of the sealing element. The row of alternate projections 40 and gaps 41 ensures that the flow of fluid from the container 11 is not impeded.

Figure 5:
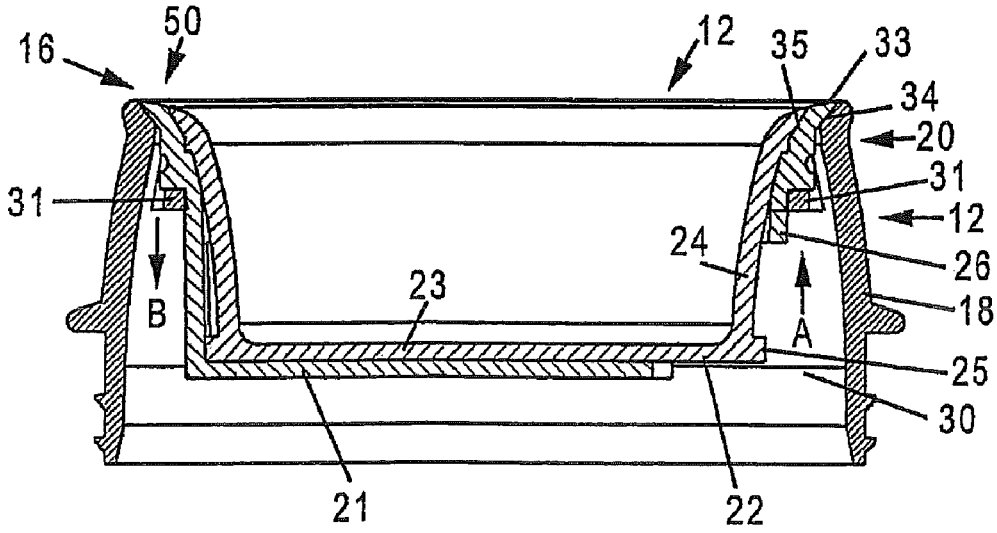
FIG. 5 is a side view of the lid sectioned along line V-V of FIG. 4
Figure 9:
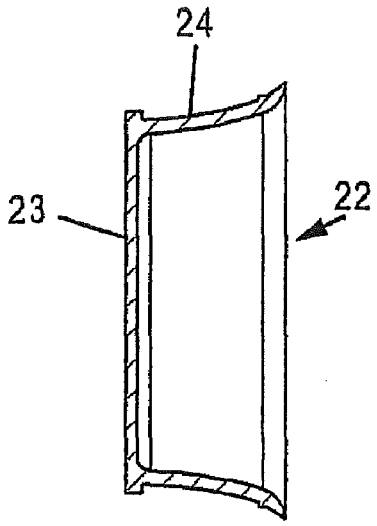
FIG. 9 is a side view of the inner member of the lid sectioned along line IX-kX of FIG. 6
Figure 6:
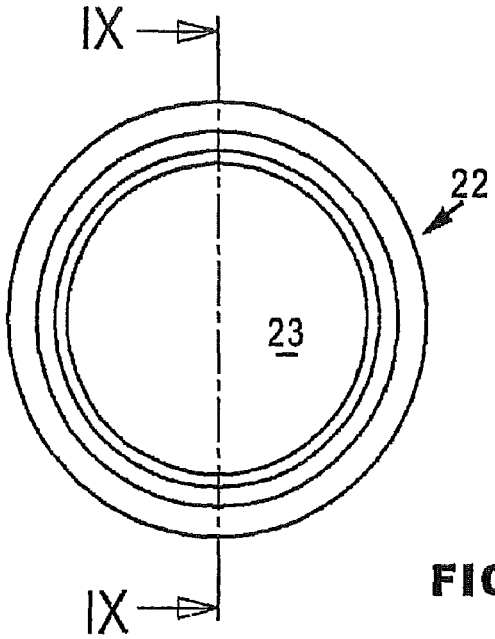
FIG. 6 is a top plan view of the inner member of the lid
Figure 7:
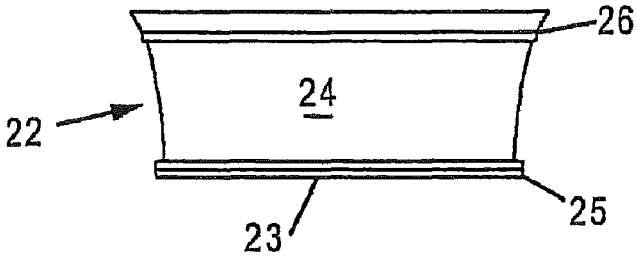
FIG. 7 is a side view of the inner member of the lid
Figure 8:
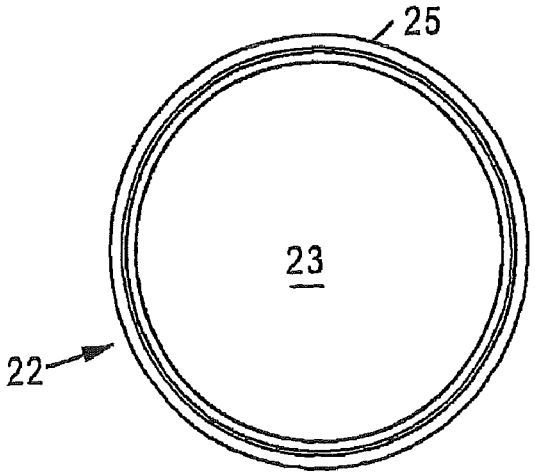
FIG. 8 is a bottom plan view of the inner member of the lid

The residence of the sealing element 21 ensures that (as illustrated in FIG. 5), the upper edge 33 of the sealing element 21 normally bears against frustoconical inner surface 34 of the outer member 20 and against the outer surface of the inner member 22. In use, a person wishing to drink liquid in the container 11 places his lips about the lip 16 of the lid 12, tips the container until the liquid flows to the sealing element 21 and sucks. The suction so created causes the portion of the sealing element 21 in the area to which the lips have been applied to separate from frusto-conical area 34 to form an opening thereby allowing liquid to flow from within the container 11 through the opening into the user's mouth as indicated by the arrow A in FIG. 5. in order to replace the liquid which flows out of the container 11 air passes into the container between the sealing element 21 and the inner member 22 and/or the outer member 20 on the side of the container remote from where the suction is being applied, as indicated by the arrow B in FIG. 5.

Whilst the container 11, the outer member 20 and the inner member 22 may be formed of any suitable material, such as rigid food-grade plastics materials, sealing element 21 is suitably formed from a resiliently deformable natural or synthetic rubber or plastics material. Latex and silicone rubber are particularly suitable materials.

It is a further advantage of the drinking vessel of the present invention that the dimensions of the sealing element 21 may be selected such that the vessel is not wholly leak-proof if shaken or inverted. This can be advantageous in terms of child development as many consider it important that a child learns that, if he does shake a cup or knock a cup over, then the result is that the drink is spilt, making a mess. It has been found that children who are given filly leak-proof trainer cups over an extended period of time can be slower in developing the appreciation that cups must be kept upright and are thus slower in making the transition from a trainer cup with a mouthpiece to a standard, lid-free, cup in a practical embodiment of the drinking vessel described above the inner diameter of the outer member 20 and the outer diameter of the inner member 22 in the region of the aperture 50 were respectively about 65 mm and about 60 mm and the thickness of the wall of the sealing element 21 was about 5 mm. The relative values of the dimensions were adjusted until the required suction effect to enable a person to drink out of the vessel was obtained While the preferred embodiments of the invention have been shown and described, it will be understood by those skilled in the art that changes of modifications may be made thereto without departing from the true spirit and scope of the invention.

I claim:

1. A drinking vessel comprising a generally cylindrical container adapted to contain liquid and a generally cylindrical lid adapted to close the container, in which the lid comprises a generally cylindrical outer member, having an annular lip at an edge thereof furthermost from the container, and an end adjacent the container, the lip extending around the entire circumferential edge of the lid;

a generally cylindrical inner member located within the outer member; and a generally cylindrical aperture extending between the end of the outer member adjacent the container and the annular lip, and a generally cylindrical sealing element located between the outer surface of the inner member and the inner surface of the outer member, said sealing element having an outer surface to provide a firm seal with the inner surface of the outer member but being deformable away from the inner surface of the outer member by suction at the end of the aperture remote from the container so as to cause liquid within the container to flow, from the end of the aperture adjacent to the container between the inner surface of the outer member and the outer surface of the sealing element, out through the aperture under the action of the suction.

2. A drinking vessel as claimed in claim 1, wherein the sealing element is located in said aperture.

3. A drinking vessel as claimed in claim 2, comprising means for holding the sealing element firmly within the aperture.

4. A drinking vessel as claimed in claim 2, in which the outer member is formed with a generally cylindrical side wall and the inner member is formed with a base and a generally cylindrical side wall so that the aperture is formed by a gap between the side walls and, and the sealing element is formed with a generally cylindrical side wall located in the aperture and a base abutting against the outer surface of the base of the inner member.

5. A drinking vessel as claimed in claim 3, comprising at least one projection extending inwardly from the inner surface of the outer member and engaging with at least one projection extending outwardly from the outer surface of the inner member and adapted to hold the inner member in a required position relative to the outer member.

6. A drinking vessel as claimed in any one of claim 3, in which the side wall of the sealing element is formed with an annular portion which is adapted to fit tightly in the aperture.

* * * * *